United States Patent [19]

Tschudin-Mahrer

[11] 4,401,716

[45] Aug. 30, 1983

[54] FOAM STRIP WOUND UP INTO A ROLL, PREFERABLY FOR SEALING PURPOSES

[75] Inventor: Rolf Tschudin-Mahrer, Lausen, Switzerland

[73] Assignee: Irbit Holding AG, Fribourg, Switzerland

[21] Appl. No.: 410,118

[22] Filed: Aug. 20, 1982

[30] Foreign Application Priority Data

Aug. 22, 1981 [DE] Fed. Rep. of Germany ..... 3133271

[51] Int. Cl.[3] ..... B32B 7/12

[52] U.S. Cl. ..... 428/317.3; 428/58; 428/318.4; 428/319.7; 428/906

[58] Field of Search ..... 428/40, 41, 354, 57, 428/58, 304.4, 317.3, 318.4, 319.7, 320.2, 906

[56] References Cited

U.S. PATENT DOCUMENTS

| | | | |
|---|---|---|---|
| 3,406,087 | 10/1968 | Potter | 428/57 |
| 4,079,170 | 3/1978 | Cluff | 428/320.2 |
| 4,181,711 | 1/1980 | Ohashi et al. | 428/40 |
| 4,320,611 | 3/1982 | Freeman | 428/304.4 |
| 4,356,676 | 11/1982 | Hauptman | 428/319.7 |
| 4,369,978 | 1/1983 | Watanabe | 428/318.4 |

*Primary Examiner*—William J. Van Balen

*Attorney, Agent, or Firm*—Martin A. Farber

[57] ABSTRACT

A strip of impregnated and compressed foam material with delayed restoration which is rolled up into a roll, preferably for purposes of sealing, and particularly for improved sealing, the broad side of the roll is provided with a liquid-impermeable layer which adheres to the flank sides of the strip and which is expandable corresponding to the amount of restoration and has a spiral-shaped separation line corresponding to the winding joint of the strip.

15 Claims, 4 Drawing Figures

1
2
3
4
4'
5
6
6'
7
8
9
10
10'
11
R
S
L

FOAM STRIP WOUND UP INTO A ROLL, PREFERABLY FOR SEALING PURPOSES

The present invention relates to a strip of impregnated and compressed foam material with delayed restoration which is wound up into a roll, preferably for sealing.

The cell walls of the open-cell skeleton of the foam material are covered e.g. with chloroparaffin in an impregnation process. The foam-strip, rolled up in a compressed state, restores itself gradually in the unrolled state. Such strips can therefore be used in advantageous manner for the sealing of joints. The restoration force provides a particularly adaptable fit to the joint walls. The restoring effect lasts for very long periods of use. Although in particular the coating with chloroparaffin already provides a certain imperviousness to the penetration of moisture, the sealing effect is not always sufficient.

The object of the invention is to provide relief in this connection in the manner that, despite the use of an open-cell material of possibly large-cell foam structure favorable for impregnation a satisfactory sealing is obtained.

This object is obtained in accordance with the invention in the manner that the broad side of the roll is provided with a liquid-impervious layer adhering to the side flanks of the strip which is expandable corresponding to the amount of the restoration and which is tearable along a spiral-shaped line corresponding to the winding joint of the strip.

As a result of such development an effective joint sealing by the installed strips is obtained despite the use of foam material of large-cell structure. The layer forms an effective moisture shield. Moisture which still creeps through, for example, in the region of the joint walls and therefore laterally, is maximally blocked by the water-repelling property of the chloroparaffin-saturated cell walls which is present from the very beginning. Furthermore, the partially compressed strip does not completely open the pores. Some even remain closed. This results in a type of labyrinth. Since the layer is advisedly faces the depths of the joint, the other side of the strip which faces the open air can also dry out well. The layer which is applied in the form of a foil, skin, a film or the like faces toward the rolled up strip, i.e. the broad side of the roll. The corresponding layer has an expandability which corresponds to the amount of the restoration of the skeleton of the foam material. At the same time the layer acts in this connection as a delaying factor. On the other hand it is so anchored to the side flanks of the strip, that upon unrolling of the strip from the roll it tears along a spiral-shaped line corresponding to the winding joint of the strip. This can be effected by a zone of intended breakage. The layer can also be prepared using chemical means, for example, with a greater brittleness in the region of the winding joint.

Further advantages and details of the subject matter of the invention are explained below on the basis of a graphically illustrated exemplary embodiment in the accompanying drawing, of which:

Figures 1, 2, 3, 4:
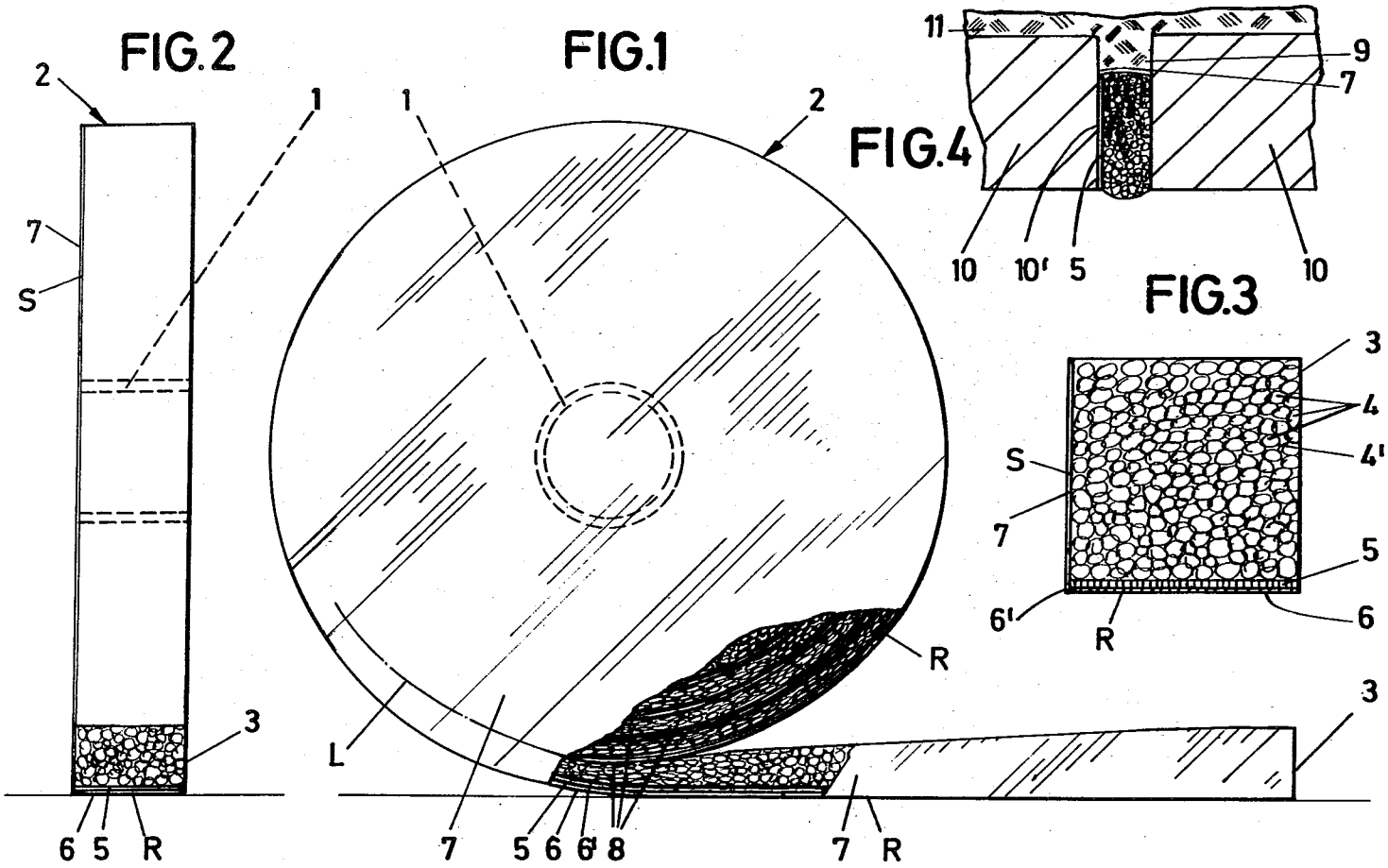
FIG. 1 shows a foam strip according to the invention rolled up as a supply roll with illustration of the liquid-impermeable layer, the latter partially broken away.
FIG. 2 is an end view of the roll.
FIG. 3 is a cross section through the maximally restored strip on a larger scale than in FIG. 1.
FIG. 4 is a cross section in the region of a masonry wall joint with the foam strip inserted for sealing purposes.

The strip 3 which is rolled up on a core 1 forming a roll 2 is made of foam material. Its structure is such that individual adjacent cells 4 are in connection with each other.

The foam material is impregnated. For this purpose there can be used for example chloroparaffin. This coats the cell walls 4'. The strip 3 is wound up under tension in such a manner that it lies flatly pressed together on the back R of the coil winding lying respectively beneath it. In this state the strip 3 has only approximately one fourth to one third of its normal height.

The back R of the strip carries a self-adhesive layer 5. This is covered by a correspondingly wide protective strip 6. The protective strip can be a paper strip with a wax layer or the like which facilitates its separation from the self-adherive layer 5.

One broad side of the roll 2 is provided with a layer 7 cemented to the strip side flank S there. This is a liquid-impervious material. The layer 7 may be developed in the form of a foil, a skin, a film or the like.

In the exemplary embodiment it is a thermoplastic foil. The layer 7 formed by it has an expandability which corresponds to the amount of restoration of the compressed strip 3.

The layer 7 is furthermore so developed that it is tearable along a spiral-shaped line L oriented according to the strip winding joint 8. The section of the strip to be laid can in this manner be released cleanly from the roll 2, taking with it the section of layer 7 fastened to the strip side flank S.

The still flat strip section, cut to length, is inserted in a gap 9 to be sealed between two adjacent plates 10, walls or the like as indicated in FIG. 4 in such a manner that the layer 7 comes to lie in the inner region of the gap 9. The layer 7 extends there, after restoration of the foam material, as a moisture barrier against soil 11 or the like which still intrudes partially into the gap or joint 9.

The above-mentioned self-adhesive layer 5 which adheres at the narrow longitudinal edge 10' of the plate 10 located there serves to fix the position of the inserted strip 3.

The line L which to a certain extent determines the tearing path can be obtained by a zone of intended breakage. This can be easily produced inasmuch as the narrow front edge 6' of the protective strip, which is stabilized by the curvature of the roll, can be used as an abutment for a stamp which sets down on it and melts the layer back somewhat in its thickness. The flank section on the side of the strip which is softer than compared to this rigid edge 6' can be pushed back upon pressing the layer part in.

I claim:

1. A strip of impregnated and compressed foam material with delayed restorability, wound up into a roll, forming a strip winding joint, wherein said strip has side flanks and said roll defines broad sides comprising said side flanks, respectively, of the strip, a liquid-impervious layer at one of said broad sides of said roll adheres to a corresponding of said side flanks of the strip, said layer being expandable corresponding to the amount of restoration of the strip, said layer being tearable along a spiral-shaped line corresponding to said strip winding joint.

2. The strip as set forth in claim 1, wherein said strip is impregnated with chloroparaffin.

3. The strip as set forth in claim 1, wherein said layer is a foil.

4. The strip as set forth in claim 1, wherein said layer is a skin.

5. The strip as set forth in claim 1, wherein said layer is a film.

6. The strip as set forth in claim 3, wherein said layer is a thermosplastic foil.

7. The strip as set forth in claim 1, wherein said layer is of greater brittleness along said spiral-shaped line corresponding to said strip winding joint than at other regions of said layer.

8. The strip as set forth in claim 1, wherein said layer has a zone of intended breakage along said spiral-shaped line corresponding to said strip winding joint, said zone having decreased thickness relative to other regions of said layer.

9. The strip as set forth in claim 1, wherein said strip in the wound up condition has a height approximately one fourth to one third of its height in an unwound condition.

10. The strip as set forth in claim 1, wherein said strip has a bottom and further comprising a self-adhesive layer at said bottom of said strip.

11. The strip as set forth in claim 10, further comprising a protective strip is disposed on said self-adhesive layer.

12. The strip as set forth in claim 11, wherein said protective strip is a paper strip with a layer means for facilitating separation from said self-adhesive layer.

13. The strip as set forth in claim 12, wherein said layer means is a wax layer.

14. The strip as set forth in claim 12, wherein said layer means is a wax-like layer.

15. The strip as set forth in claim 1, wherein said liquid-impervious layer at said one broad side is disposed only at said one broad side of said roll, the strip at said other broad side being uncovered.

* * * * *